US005243383A

United States Patent [19]

Parisi

[11] Patent Number: 5,243,383

[45] Date of Patent: Sep. 7, 1993

[54] IMAGE FORMING APPARATUS WITH PREDICTIVE ELECTROSTATIC PROCESS CONTROL SYSTEM

[75] Inventor: Michael A. Parisi, Fairport, N.Y.

[73] Assignee: Xerox Corporation, Stamford, Conn.

[21] Appl. No.: 904,926

[22] Filed: Jun. 26, 1992

[51] Int. Cl.[5] ..... G03G 21/00

[52] U.S. Cl. ..... 355/208; 324/452; 355/219; 355/246

[58] Field of Search ..... 355/208, 246, 219, 221; 430/35, 902; 324/452, 455, 457

[56] References Cited

U.S. PATENT DOCUMENTS 4,319,544 3/1982 Weber ..... 118/647

4,355,885 10/1982 Nagashima ..... 355/208

OTHER PUBLICATIONS

Co-Pending U.S. application Ser. No. 07/752,793 Inventor: Kreckel, Filed Aug. 30, 1991.

*Primary Examiner*—Leo P. Picard

*Assistant Examiner*—Christopher Horgan

*Attorney, Agent, or Firm*—Denis A. Robitaille

[57] ABSTRACT

An electrostatographic printing machine having a charge control system incorporated therein, wherein first and second surface voltage potentials on the imaging surface are measured to determine a dark decay rate model representative of surface voltage potential decay on the imaging surface with respect to time, and the dark decay rate model is used to determine the surface potential voltage at any point on the imaging surface corresponding to a given charge voltage. This information is used for providing a predictive model to determine the charge voltage required to produce a target surface voltage potential at a selected point on the imaging surface.

22 Claims, 2 Drawing Sheets

IMAGE FORMING APPARATUS WITH PREDICTIVE ELECTROSTATIC PROCESS CONTROL SYSTEM

This invention relates generally to an electrostatographic printing machine and more particularly, concerns a process control system for use in a multi-color electrophotographic printing machine.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know the surface potential on the photoreceptor at each of the color developing areas in the developing zone, it would be necessary to locate a voltmeter at each color area within the developing zone. Cost and space limitations make such an arrangement undesirable.

An alternative method of monitoring and controlling surface potential is to place electrometers outside the development zone and to use the electrometers to monitor the surface potential of the photoreceptor. Such an approach requires a means for relating the voltages which are read by the remotely located electrometers to the voltage on the photoreceptor when it reaches the development zone. In general, there will be a difference, or error, between those two voltages; that error will increase as the distance between electrometer and development zone increases. Furthermore, the error magnitude is expected to be different for each development zone in the system.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling charging processes within a printing machine. The present invention describes a method for controlling the voltage at a predetermined point on a photoreceptor over multiple iterations to assure that a given surface voltage exists on the photoreceptor at each of several developer housings. The following disclosures may be relevant to various aspects of the present invention:

U.S. Pat. No. 4,355,885
Patentee: Nagashima
Issued: Oct. 26, 1982
Co-pending U.S. application Ser. No. 07/752,793
Inventor: Kreckel
Filed: Aug. 30, 1991

The relevant portions of the foregoing disclosures may be briefly summarized as follows:

U.S. Pat. No. 4,355,885 discloses an image forming apparatus having a surface potential control device wherein a magnitude of a measured value of the surface potential measuring means and an aimed or target potential value are differentiated. The surface potential control device may repeat the measuring, differentiating, adding and subtracting operations, and can control the surface potential within a predetermined range for a definite number of times.

Commonly assigned U.S. patent application Ser. No. 07/752,793 is directed toward a method for determining photoreceptor potentials wherein a surface of the photoreceptor is charged at a charging station and the charged area is rotated and stopped adjacent an electrostatic voltmeter. The electrostatic voltmeter provides measurements at different times for determining a dark decay rate of the photoreceptor, which allows for calculation of surface potentials at other points along the photoreceptor belt.

In accordance with one aspect of the present invention, there is provided an electrostatographic printing machine having an imaging member with a surface voltage potential on a portion thereof. The electrostatographic printing machine includes a charge control system having means at a first location, for measuring a first surface voltage potential on the imaging surface, means at a second location, for measuring a second surface voltage potential on the imaging surface, means for determining a dark decay rate model representative of surface voltage potential decay on the imaging surface with respect to time, and means for determining, at a selected location, the surface voltage potential corresponding to a given charge voltage generated to apply the surface voltage potential on the imaging member.

Pursuant to another aspect of the invention, there is provided an apparatus for controlling charge voltage adapted to generate a surface voltage potential on an imaging surface, including means at a first location for measuring a first surface voltage potential on the imaging surface, means at a second location, for measuring a second surface voltage potential on the imaging surface at a predetermined time subsequent to the initial surface voltage potential measurement, means for determining a dark decay rate model representative of the surface voltage potential decay on the imaging surface with respect to time, means for determining at any selected location on the imaging surface, the surface voltage potential as a function of the charge voltage.

Pursuant to yet another aspect of the present invention, there is provided a method for controlling discrete functions in an iterative process, including the steps of generating successive input conditions, monitoring output conditions resulting from each successive input condition to collect a plurality of data points corresponding to each successive input condition and the output conditions related thereto, analyzing the plurality of data points for each successive input condition to generate a model representing a relationship between input conditions and output conditions, generating a predictive model in response to the analyzing step to determine the input condition necessary to provide a selected output condition, and updating the model with each monitoring and analyzing step to maintain an up-to-date relationship between input conditions and output conditions.

Other features of the present invention will become apparent as the following description proceeds and upon reference to the drawings, in which.

While the present invention is described hereinafter with respect to a preferred embodiment, it will be understood that this detailed description is not intended to limit the scope of the invention to that embodiment. On the contrary, the description is intended to include all alternatives, modifications and equivalents as may be considered within the spirit and scope of the invention as defined by the appended claims.

Figure 3:
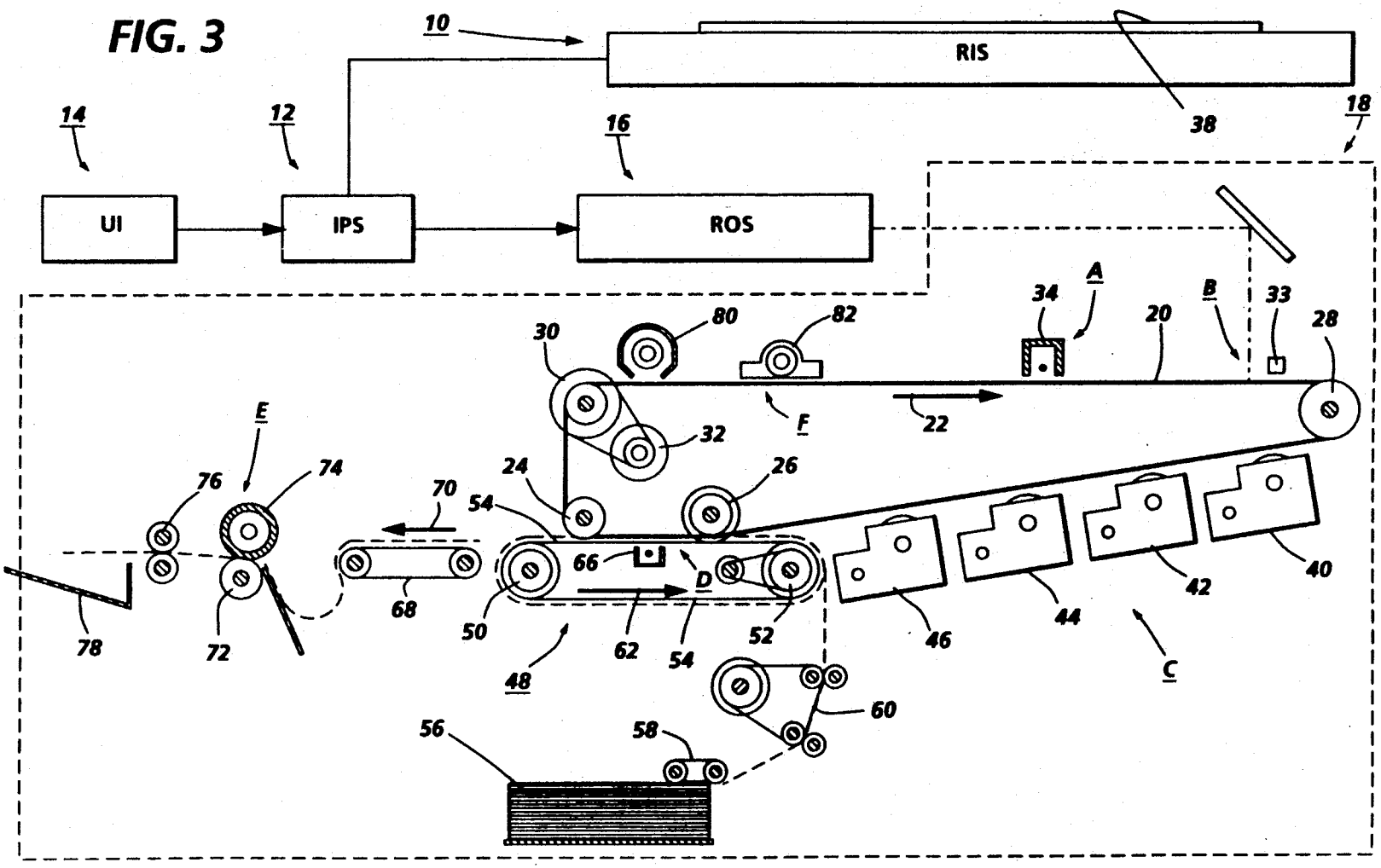
FIG. 3 is a schematic elevational view of an exemplary multi-color electrophotographic printing machine which can be utilized in the practice of the present invention.

For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 3. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Turning initially to FIG. 3, before describing the particular features of the present invention in detail, an exemplary electrophotographic copying apparatus will be described. The exemplary electrophotographic system may be a multicolor copier, as for example, the recently introduced Xerox Corporation "5775" copier. To initiate the copying process, a multicolor original document 38 is positioned on a raster input scanner (RIS), indicated generally by the reference numeral 10. The RIS 10 contains document illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18. Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 3, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diamino-triazines and polynuclear aromatic quinines. Typical organic resinous binders include polycarbonates, acrylate polymers, vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 3, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, generally indicated by reference numeral 64, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

The foregoing description should be sufficient for purposes of the present application for patent to illustrate the general operation of an electrophotographic printing machine incorporating the features of the present invention. As described, an electrophotographic printing system may take the form of any of several well known devices or systems. Variations of specific electrophotographic processing subsystems or processes may be expected without affecting the operation of the present invention.

Referring now to the specific subject matter of the present invention, the operation thereof will be described hereinafter with reference to FIGS. 1-3. It is noted that in order to achieve acceptable multi-color copy quality, it is essential to provide a predetermined development voltage potential on the photoconductive belt at each of the several developer housings. The predetermined voltage, or so-called target development voltage, generally differs for each developer housing since each developer housing may have a different electrostatic operating point. The target voltage at each developer housing is independent from the voltage at the other developer housings and the target voltage at a particular housing for a particular job may vary independently from the voltage at that particular developer housing for a previous job. Moreover, it is important to note that an applied voltage at the charging station A yields different voltages at different developer housings along the photoreceptor path due to a phenomenon called "dark decay" and that the photoconductive surface responds to charge differently over the life of the photoconductor as well as over the span of time between copies within a job, called "fatigue", or between jobs due to a phenomenon called "rest recovery".

The concept of the present invention determines dark decay by measuring the difference in voltage at two points on the photoreceptor. The description of the preferred embodiment assumes the use of a charging device of the type having a coronode wire and a screen or grid wires. The charging device acts as a constant current charging device and, in fact, acts as an indicator of the voltage on the photoreceptor. Such devices are well known in the art. A suitable charging device is disclosed in U.S. Pat. No. 4,868,907 which is incorporated by reference herein. An electrostatic voltmeter (ESV) provides a second voltage measurement to complete the requirements to estimate the dark decay. It will be understood by one of skill in the art that another embodiment could use two electrostatic voltmeters to provide the data used to estimate the dark decay.

A segment of the photoreceptor surface is first charged at charging station A using a controlled charge voltage to generate a surface voltage potential on the photoconductor as in the manner used to charge the photoreceptor surface for standard latent image formation. The charged segment of the photoreceptor surface is advanced in the direction of the electrostatic voltmeter 33 where the electrostatic voltmeter measures the surface potential on the photoreceptor. The surface potential on the photoreceptor at the instant of charging ($V_0$) and at the point of measurement by the ESV ($V_{ESV}$), in combination with the known distance between these points, provides the data necessary for determining the rate of dark decay of the charged surface. For a known photoreceptor material, these two points provide the information necessary to determine a dark decay model representing the voltage decay on the photoreceptor relative to a given charge voltage with respect to time.

The dark decay rate model, in combination with other system parameters, are used to provide an estimate of development potential at a given developer housing. A most significant and important feature of the present invention is the ability of this system to accommodate and achieve any target voltage without iteration. Thus, the present invention provides a method for controlling discrete functions in an iterative process. The method of the present invention monitors output conditions resulting from successive input conditions in an iterative to collect data pints related thereto and subsequently analyzes these data points to generate a model representing a relationship between the input and output conditions. This relational model is used to generate a predictive model for determining the input condition necessary to provide a selected output condition. Furthermore, the model is continuously updated to maintain an up-to-date relationship between input conditions and output conditions, yielding a more accurate predictive model. More particularly, in the electrostatographic machine enviroment, the present invention utilizes the experiences of each development cycle to improve the performance for all the developer housings. The only limitation is the accuracy of the predictive equation in modeling the dark decay and therefore determining the housing voltage.

The initial surface potential on the photoreceptor immediately following charging at charging station A is measured by the charging device control grid and can be given by the equation:

$$V_0 = V_{GRID} + A \qquad [1]$$

where $V_{GRID}$ is the voltage on the grid of the charging corona generator and A is the system gain parameter as defined by the relationship between the charging device and the photoreceptor surface voltage. Equation 1 is known in the art and assumes the use of a control grid to provide electrostatic voltage measurement, however, an electrostatic voltmeter may be used to provide this initial surface voltage measurement.

The surface potential V of the photoreceptor decays in the dark from an initial voltage $V_0$ such that a time dependent relationship can be described by the expression:

$$V(t) = V_0 + \beta t^d \qquad [2]$$

where t is measured from the completion of charging. In this equation, $\beta$ is a dark decay parameter which depends on the photoreceptor materials, varying, in general, with photoreceptor structure materials and batch, and $^d$ is a parameter which is dependent on the type of photoreceptor used. For the type of photoreceptor described herein, $\beta$ can be expressed as $B_0 + B_1 V_{GRID}$ where $B_0$ and $B_1$ are field independent and field dependent components of the dark decay rates for the photoreceptor, respectively. For the type photoreceptor described herein, $^d$ is equal to ¼ such that $t^d$ represents the quarter power of the time between the location at which $V_0$ and V(t) are measured. Thus, equation 2 can be expanded as:

$$V(t)=V_0+(B_0+B_1V_{GRID})t^{\frac{1}{4}} \quad [3]$$

Figure 1:
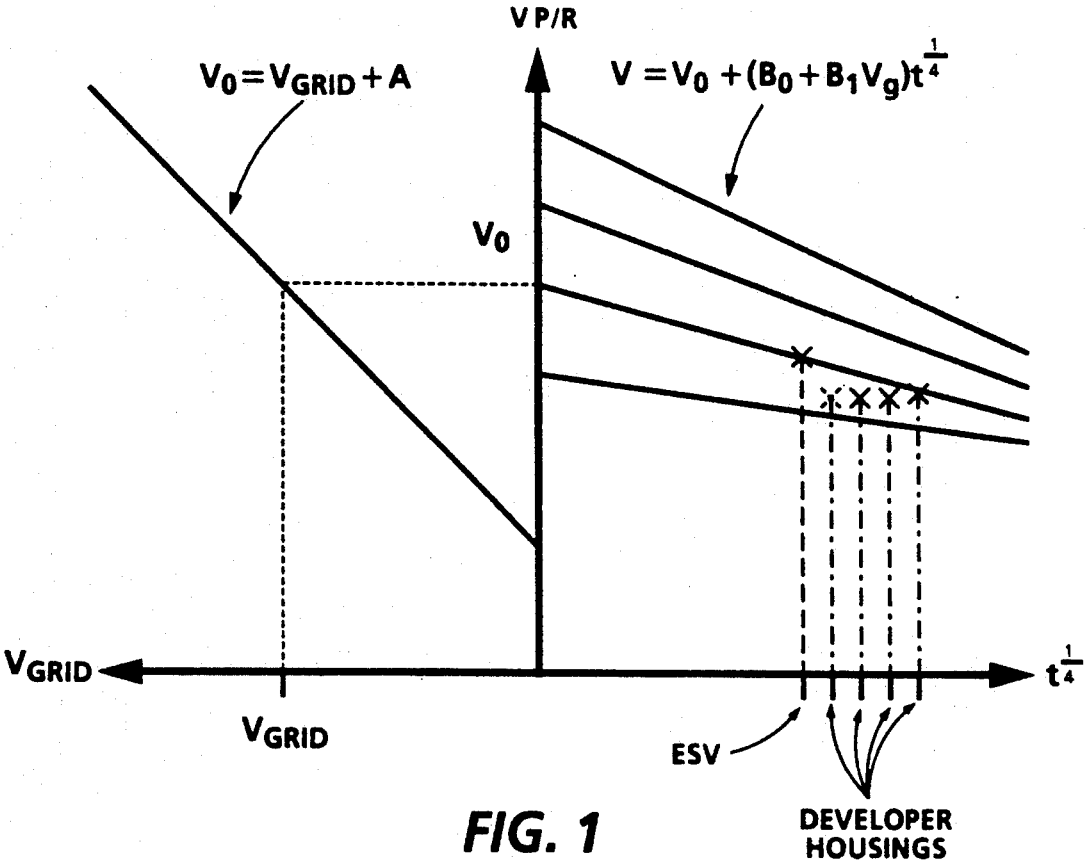
FIG. 1 is a Jones Plot providing a graphic representation of voltage and time relationships as utilized in the present invention.

A Jones Plot providing a graphic representation of equations 1 and 3 is shown in FIG. 1, where equation 1 is shown in the left hand quadrant, while equation 3 is shown in the right hand quadrant. The slope of each of the four lines in the right hand quadrant of FIG. 1 is equal to $\beta$, each line representing the photoreceptor voltage dark decay from a given initial surface voltage with respect to time.

It can be seen from the Jones Plot of FIG. 1 that is possible to determine $V_0$ for any given $V_{GRID}$. This determination of $V_0$ then allows for a determination of the surface voltage at a predetermined developer housing for the given $V_{GRID}$. Conversely, any predetermined target voltage can be used to determine $V_0$ as well as the corresponding required $V_{GRID}$, as will be described.

Equation 1 is substituted for $V_0$ in equation 3 and equation 3 is rearranged to provide a predictive model permitting the determination of $V_{GRID}$ from a predetermined or target voltage for a given developer housing at a time t as follows, wherein the voltage at a predetermined developer housing is V(t), which will be called $V_{TARGET}$:

$$V_{GRID}=\frac{V_{TARGET}-a-b_0t^{\frac{1}{4}}}{(1+b_1t^{\frac{1}{4}})} \quad [4]$$

Note that a, $b_0$ and $b_1$ are used to indicate estimated values for the A, $B_0$ and $B_1$ equations 1-3. These estimates, $b_0$ and $b_1$, represent the estimate of the system gain, the field independent dark decay rate and the field dependent dark decay rate, respectively. The estimated values of $b_0$ and $b_1$ are updated with each sample iteration or the making of a photoreceptor panel, as will be described, while the value of a, as determined from Equation 1, is established during a machine setup routine and is updated at regular intervals.

In the practice of the present invention, as each photoreceptor panel is processed, parameter samples $b_0^s$ and $b_1^s$ are calculated from ESV voltage measurements during normal operations via the following equations:

$$b_1^s=\frac{\Delta V_{ESV}}{(\Delta V_{GRID})t^{\frac{1}{4}}}-\frac{1}{t^{\frac{1}{4}}} \quad [5]$$

$$b_0^s=\frac{V_{ESV}-a-V_{GRID}(1+b_1^st^{\frac{1}{4}})}{t^{\frac{1}{4}}} \quad [6]$$

where $\Delta V_{ESV}$ and $\Delta V_{GRID}$ represent the difference between current ESV or GRID voltages and previous ESV or GRID voltages, respectively, for each photoreceptor panel.

These calculated parameter samples are subsequently exponentially smoothed to estimate the true values of $B_1$ and $B_0$. The combination of the parameter sample equations and the exponential smoothing is equivalent to exponential weighting as represented by the following equations:

$$b_0=b_0(1-\omega_0)=b_0^s(\omega_0) \quad [7]$$

$$b_1=b_0(1-\omega_1)=b_1^s(\omega_1) \quad [8]$$

In the preceding smoothing equations, $\omega_0$ and $\omega_1$ are the exponential weighting factor applied to $b_0$ and $b_1$, respectively, where each model parameter is updated at the end of each interval or at the end of each processing period for a photoreceptor panel. Equations 7 and 8, combined with Equations 5 and 6, form a regression model which discounts data over time and provides a computationally efficient method of weighting older data with current input data to obtain current accurate and valid coefficient estimates.

Figure 2:
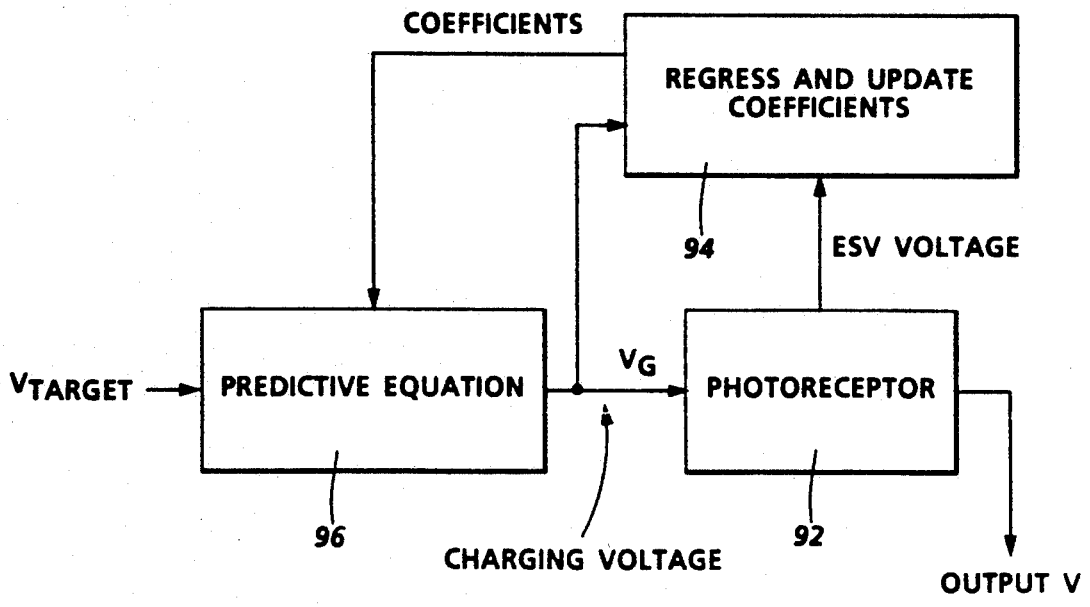
FIG. 2 is a system block diagram of the charge control system of the present invention.

An illustrative control system block diagram for providing the above calculations and for utilizing this information to control the charging device is shown in FIG. 2. These calculations are implemented via an existing microprocessor incorporated into most electrophotographic machines, as for example an 8085 microprocessor chip. The photoreceptor model equations 1 and 3 are an adequate description of the photoreceptor and are graphically represented by block 92, labeled "photoreceptor". The determination of sample values $b_0$ and $b_1$ is provided in block 94 labeled "Regress and Update Coefficients". This component of the block diagram receives input data regarding past and present ESV and GRID voltages and processes this data through the regression equations described hereinabove (Equations 5, 6, 7 and 8) to provide coefficients for use in the "Predictive Equation" block 96. The predictive Equation (4) allows for a determination of a charging voltage ($V_{GRID}$) for driving the control grid from the predetermined target voltage. This $V_{GRID}$ charging voltage will be adjusted in compensation for variations to achieve the desired output voltage. In FIG. 2, $V_{TARGET}$ and output V should be equivalent in the system of the present invention.

In recapitulation, it is evident that the predictive charge control system of the present invention uses voltage measurement information from the grid of a corona generator and from an electrostatic voltage measurement device for past and present print cycles to predict the grid control signal for the next successive photoreceptor print cycle. The apparatus and method of the present invention provides for charge control for generating a specified voltage on a photoconductive device as a function of an arbitrarily predetermined target voltage and a predicted control signal to assure high quality output images from a multi-color, multipass electrophotographic printing machine. The utilization of this predictive control system in color printing machines has proven to be very effective in providing consistently high quality output prints. It will be understood that the predictive control system of the present invention can be adapted for use in numerous concepts beyond charge control and can be expanded to concepts beyond electrophotography wherein multiple variable outputs can be controlled from predictive test data.

It is, therefore, apparent that there has been provided in accordance with the present invention, a charge control system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrostatographic printing machine having an imaging member with a surface voltage potential on a portion thereof, said electrostatographic printing machine including a charge control system, comprising:

first means at a first location for measuring a first surface voltage potential on the imaging member to provide an initial surface voltage potential measurement;

second means at a second location for measuring a second surface voltage potential on the imaging surface to provide a second surface voltage potential measurement;

means, responsive to said initial surface voltage potential measurement and said second surface voltage potential measurement, for determining a dark decay rate model representative of surface voltage potential decay with respect to time; and means, responsive to said dark decay rate model, for determining, at a selected location, the surface voltage potential as a function of charge voltage generated to apply the surface voltage potential on the imaging member.

2. The electrostatographic printing machine of claim 1, further including means for providing a predictive model to determine the charge voltage required to produce a predetermined surface voltage potential at the selected location.

3. An electrostatographic printing machine having an imaging member with a surface voltage potential on a portion thereof, said electrostatographic printing machine including a charge control system, comprising:

first means at a first location for measuring a first surface voltage potential on the imaging member to provide an initial surface voltage potential measurement;

second means at a second location for measuring a second surface voltage potential on the imaging surface to provide a second surface voltage potential measurement;

means, responsive to said initial surface voltage potential measurement and said second surface voltage potential measurement, for determining a dark decay rate model representative of surface voltage potential decay with respect to time;

means, responsive to said dark decay rate model, for determining, at a selected location, the surface voltage potential as a function of charge voltage generated to apply the surface voltage potential on the imaging member; and means for providing a predictive model to determine the charge voltage required to produce a predetermined surface voltage potential at the selected location, wherein said predictive model is determined in accordance with the following equation:

$$V_{GRID} = \frac{(V_{TARGET} - a - b_0 t^{\frac{1}{4}})}{(1 + b_1 t^{\frac{1}{4}})}$$

where $V_{GRID}$ represents the charge voltage at the charging device;

$V_{TARGET}$ represents the target surface voltage potential;

a represents a system gain parameter;

t represents time; and $b_0$ and $b_1$ represent estimates of field independent and field dependent components of the dark decay rate model, respectively.

4. The electrostatographic printing machine of claim 3, including updating means for updating the values of $b_0$ and $b_1$ each time the charging means is activated.

5. The electrostatographic printing machine of claim 4, including regression means for smoothing said updated values of $b_0$ and $b_1$ by using previous values of $b_0$ and $b_1$ with current values for both $b_0$ and $b_1$ to obtain estimates of $b_0$ and $b_1$.

6. The electrostatographic printing machine of claim 5, wherein said regression means includes means for exponentially smoothing said updated values of $b_0$ and $b_1$ by exponentially weighting the previous values of $b_0$ and $b_1$ with current values of $b_0$ and $b_1$ to obtain estimates of $b_0$ and $b_1$.

7. The electrostatographic printing machine of claim 1, further including charging means for generating a charge voltage to apply the surface voltage potential on the imaging surface.

8. The electrostatographic printing machine of claim 7, wherein said charging means includes a control grid.

9. The electrostatographic printing machine of claim 8, wherein said first means for measuring surface voltage potential includes said control grid.

10. The electrostatographic printing machine of claim 1, wherein said first and second means for measuring surface voltage potential include electrostatic voltmeters, respectively.

11. The electrostatographic printing machine of claim 2, including a plurality of developer housings positioned along a path of travel of the imaging member, wherein the selected location corresponds to one of said plurality of developer housings.

12. An apparatus for controlling charge voltage adapted to generate a surface voltage potential on an imaging surface, comprising:

first means, at a first location, for measuring a first surface voltage potential on the imaging surface to provide an initial surface voltage potential measurement;

second means, at a second location, for measuring a second surface voltage potential on the imaging surface to provide a second surface voltage potential measurement;

means, responsive to said initial surface voltage potential measurement and said second surface voltage potential measurement, for determining a dark decay rate model representative of surface voltage potential decay with respect to time; and means, responsive to said dark decay rate model, for determining at a selected location, the surface voltage potential as a function of the charge voltage.

13. The apparatus of claim 12, further including means for providing a predictive model to determine the charge voltage required to produce a predetermined surface voltage potential at the selected location.

14. An apparatus for controlling charge voltage adapted to generate a surface voltage potential on an imaging surface, comprising:

first means, at a first location, for measuring a first surface voltage potential on the imaging surface to provide an initial surface voltage potential measurement;

second means, at a second location, for measuring a second surface voltage potential on the imaging surface to provide a second surface voltage potential measurement;

means, responsive to said initial surface voltage potential measurement and said second surface voltage potential measurement, for determining a dark decay rate model representative of surface voltage potential decay with respect to time;

means, responsive to said dark decay rate model, for determining at a selected location, the surface voltage potential as a function of the charge voltage; and means for providing a predictive model to determine the charge voltage required to produce a predetermined surface voltage potential at the selected location, wherein said predictive model is determined in accordance with the following equation:

$$V_{GRID} = \frac{(V_{TARGET} - a - b_0 t^{\frac{1}{2}})}{(1 + b_1 t^{\frac{1}{2}})}$$

where $V_{GRID}$ represents the charge voltage at the charging device;

$V_{TARGET}$ represents the target surface voltage potential;

a represents a system gain parameter;

t represents time; and $b_0$ and $b_1$ represent estimates of field independent and field dependent components of the dark decay rate model, respectively.

15. The apparatus of claim 14, including updating means for updating the values of $b_0$ and $b_1$ each time the charging means is activated.

16. The apparatus of claim 15, including regression means for smoothing said updated values of $b_0$ and $b_1$ by using previous values of $b_0$ and $b_1$ with current values for both $b_0$ and $b_1$ to obtain estimates of $b_0$ and $b_1$.

17. The apparatus of claim 16, wherein said regression means includes means for exponentially smoothing said updated values of $b_0$ and $b_1$ by exponentially weighting the previous values of $b_0$ and $b_1$ with current values of $b_0$ and $b_1$ to obtain estimates of $b_0$ and $b_1$.

18. The electrostatographic printing machine of claim 12, further including charging means for generating a charge voltage to apply the surface voltage potential on the imaging surface.

19. The apparatus of claim 18, wherein said charging means includes a control grid.

20. The apparatus of claim 19, wherein said first means for measuring surface voltage potential includes said control grid.

21. The apparatus of claim 12, wherein said first and second means for measuring surface voltage potential include electrostatic voltmeters, respectively.

22. A method for providing control of discrete functions in an iterative process, comprising the steps of:

generating successive input conditions;

monitoring output conditions resulting from each successive input condition to collect a plurality of data points corresponding to each successive input condition and the output conditions related thereto;

analyzing said plurality of data points for each successive input condition to generate a model representing a relationship between input conditions and output conditions; generating a predictive model in response to said analyzing step to determine the input condition necessary to provide a selected output condition; and updating said model with each said monitoring and analyzing step to maintain an up-to-date relationship between input conditions and output conditions.

* * * * *